United States Patent [19]

Persch

[11] Patent Number: 4,915,239

[45] Date of Patent: Apr. 10, 1990

[54] BOTTLE DISPENSER FOR SETTING ON TABLES

[76] Inventor: Johannes Persch, Waldschmidtstr. 6, D-8130 Starnberg, Fed. Rep. of Germany

[21] Appl. No.: 294,127

[22] Filed: Jan. 6, 1989

[30] Foreign Application Priority Data

Jul. 26, 1988 [DE] Fed. Rep. of Germany ..... 3825360

[51] Int. Cl.[4] ..... A47F 7/00

[52] U.S. Cl. ..... 211/74; 211/77

[58] Field of Search ..... 211/74, 77, 78, 131; 108/25; 248/310, 311.2, 313

[56] References Cited

U.S. PATENT DOCUMENTS

| | | | |
|---|---|---|---|
| 367,329 | 7/1887 | Witherell | 211/77 |
| 401,829 | 4/1889 | Hall | 211/77 |
| 2,003,135 | 5/1935 | Bowman | 211/74 X |
| 2,281,849 | 5/1942 | McCoppin | 211/77 |
| 2,739,759 | 3/1956 | Davidson et al. | 211/77 X |
| 2,880,882 | 4/1959 | Lipka | 211/77 |
| 3,352,427 | 11/1967 | Lawrence et al. | 211/74 |

*Primary Examiner*—Robert W. Gibson, Jr.

*Attorney, Agent, or Firm*—Cushman, Darby & Cushman

[57] ABSTRACT

A bottle dispenser for setting on tables comprises a locking device (16) which prevents the bottles (4) from falling out the receptacles (3) when the locking device is in the locking position. The bottles can be removed from the dispenser in the removal position. The bottles are preferably slightly outwardly inclined by the locking device in the locking position so that the bottles are proffered in a more appealing manner.

13 Claims, 2 Drawing Sheets

BOTTLE DISPENSER FOR SETTING ON TABLES

The present invention relates to a bottle dispenser for setting on tables, etc. consisting of a base. The base has receptacles for bottles into which the bottles are placed from above and from which they can be upwardly removed.

BACKGROUND OF THE INVENTION

Bottle dispensers which are set on tables are known. They provide a means, for example, to offer guests small bottles containing alcoholic beverages. In order that the label of the bottles located in the dispenser remains legible, the receptacles can be constructed with only a relatively shallow base. This has the consequence that when the bottle dispensers are rapidly handled, e.g. when clearing off the tables, the bottles can fall out of the bottle dispenser.

SUMMARY OF THE INVENTION

The object of the present invention is to provide a bottle dispenser of the type described above in which he bottles are secured against falling out and in which the label applied to the bottles nevertheless remains quite visible.

These and other objects are achieved, in accordance with the invention, in a bottle dispenser provided with a locking device which acts simultaneously on all bottles. The locking device has a locking position, in which it prevents the bottles from falling out of the bottle dispenser by means of projecting parts which engage into recesses or cross-sectional taperings of the bottle shape, and a removal position, in which the bottles can be placed into and removed from the bottle dispenser.

The locking device of the bottle dispenser of the invention can be brought into two positions, namely, into a locking position in which the bottles are held fast in the dispenser and into a receiving position in which the dispenser can be filled and emptied. In the locking position, a projecting part of the locking device engages into tapered areas elements located on the bottle contours. This cross-sectional tapering can be e.g. the transition from the body of the bottle to the bottle neck; however, it can also be a constriction on the body of the bottle which is preferably located immediately above the bottle foot.

Instead of the cross-sectional tapering which extends over the entire circumference of the bottle, the bottle can also have a recess located on one side into which a projecting part of the locking device engages. This can prevent the bottles, in addition to falling out of the dispenser, from rotating about their axes, e.g., in order to hold the bottles in a position in which the label can be easily read from the outside.

It is understood that the bottle dispenser of the present invention can be set not only on tables but wherever bottles are offered for sale, e.g. on bars, counters, etc.

In a preferred embodiment, the receptacles for the bottles are arranged in a regular fashion around a central, vertical axis; this has the advantage that the locking device, which acts on all the bottles, can be designed in an especially simple manner.

In an especially preferred embodiment, the bottles contained in the dispenser are brought by the locking device in the locking position into an outwardly inclined position. This results in a more pleasing arrangement of the bottles than is the case in the known dispensers in which they are vertical. The slight outward inclination of the bottles is more appealing to a potential customer, which increases the turnover of the bottles being offered for sale. This appeal is also supported by the design of the bottle dispenser of the invention, which is able, because the labels are visible, to attract the interest of a potential customer to itself.

The locking device can consist e.g. of a star arranged in the upper area of the base. The star can rotate around its vertical axis and comprises as many projections and recesses as the number of bottles the dispenser can receive. The star is rotated in such a manner that, in the removal position, its recesses are located over the receptacles for the bottles. On the other hand, in the locking position, the projections of the star extend over the receptacles for the bottles and cooperate with a cross-sectional tapering or recess on the bottles to prevent them from falling out. The star also preferably presses the bottles outward in the locking position in this embodiment, so that they rest with a slight incline in the receptacle.

In an especially preferred embodiment, the locking device consists of an upper star and a lower star which are connected to one another by a connection shaft in such manner that they do not rotate with respect to each other. The projections of the lower star engage into tapered portions of the bottles immediately above the bottle feet when the locking device is in the locking position. The projections of the upper star press the bottles outward in the locking position so that they rest with a slight incline on the wall of the receptacle. The projections of the stars can be slightly concave so that they hold the bottles fast in conformity with their surface curvature. On the other hand, a convex curvature of the projections of the stars makes it easier for the locking device to rotate between the locking position and the removal position.

The upper star is preferably connected to a handle which extends in height over the bottles in the bottle dispenser in such manner that the star does not rotate relative to the handle. With the aid of the handle, the locking device can be actuated in an unimpeded manner. Moreover, the handle can assume the function of an additional advertisement—it can be designed, e.g., in the form of a bottle.

Alternatively, a detachable handle fastening may be used, e.g., by means of inserting, wedging or hooking the handle in a corresponding fastening part. In this case, the handle can be designed as a bottle or in any desired manner.

In another advantageous embodiment, the locking device consists of a rotatable ring located in the lower section of the base. The ring has as many recesses as the dispenser has receptacles for the bottles and has inwardly directed projections between the recesses. These projections press the bottles inward in the vicinity of their feet, which brings about the advantageous outward inclination of the bottles. These projections can engage into a corresponding cross-sectional tapering or recess of the bottles immediately above their feet. The engagement into the cross-sectional tapering or recess on the bottles can also take place by means of an edge on the base against which the bottles are pressed in their oblique position by the rings. The rotation of the ring in relation to the base can take place by means of a centrally located handle; likewise, the ring can be designed in such a manner that it forms a support for the base and, as it is accessible from the outside, can be rotated relative to the latter. In this instance, a central handle is not needed.

In addition to the receptacles for the bottles, the bottle dispensers of the invention can comprise other receptacles e.g. for toothpicks or matches.

The bottle dispenser may be made from, e.g., wood, plastic, cardboard, ceramic, glass and Plexiglas.

A preferred embodiment of the bottle dispenser of the invention includes a stop device which stops the locking device in the locking position and in the removal position so that an unintentional rotation is prevented.

In conformity with the design and the size of the locking device, the bottles have a contour suitable for cooperating with the locking device.

The bottles suitable for cooperating with preferred embodiments of the bottle dispenser of the invention have a cross-sectional tapering immediately above the bottle foot into which corresponding parts of the locking device can engage. The cross-sectional tapering can be constant from the top to the bottom so that the lower section of the bottle is conical in its entirety; it is likewise possible that the cross-sectional tapering immediately above the foot consists of a constriction and that the bottle is otherwise essentially cylindrical.

BRIEF DESCRIPTION OF FIGURES OF DRAWING

The invention is described below in more detail in the following with reference to the drawing in which.

DETAILED DESCRIPTION OF PREFERRED EMBODIMENT

Figure 1:
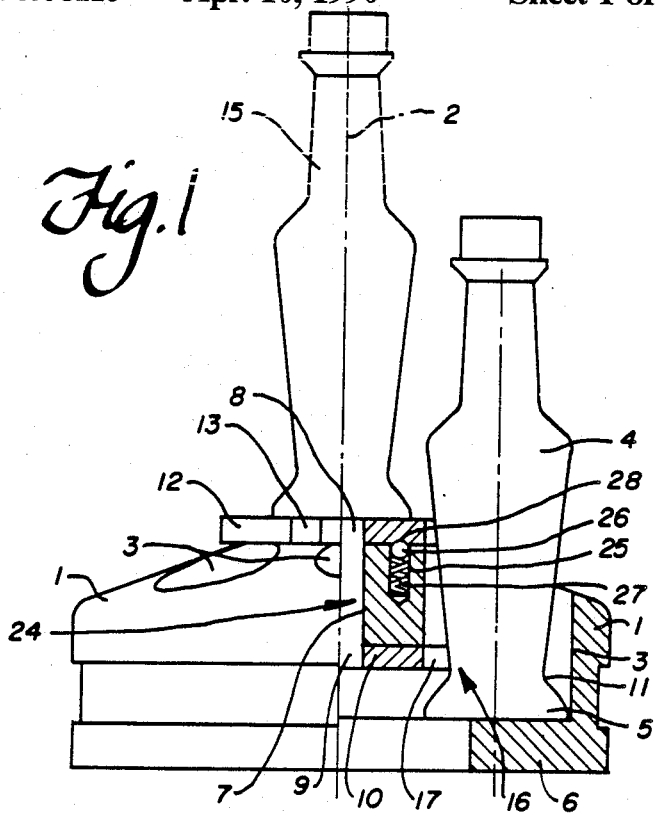
FIG. 1 is a side elevation, partially in section, of an embodiment of the invention in the removal position.

As seen in the drawings, the bottle dispenser is used with bottles 4 which include a tapered foot 5. The dispenser includes a base 1 which is rotationally symmetrical in relation to the vertical axis 2. The dispenser has five receptacles 3 for the bottles 4, which are arranged evenly around the vertical axis. Receptacles 3 are formed by bores with a vertical axis and have a diameter which is slightly larger than the diameter of the foot 5 of the bottle 4. Below the receptacle 3, the base 1 has an annular section 6 of on which the foot of the bottle stands.

Base 1 also has a central bore 7 through which connecting shaft 8 extends. At the lower end of connecting shaft 8 there is a star 10 which is permanently connected to the connecting shaft 8. The dimensioning is such that lower star 10 is located at a slightly higher level than the narrowest cross section of the cross-sectional tapering 11 of the bottle. An upper star 12 which has the same shape as the lower star 10, is also permanently connected to connecting shaft 8 in such a manner that projections 13 and recesses 14 of both stars are aligned with each other. A handle 15, which may be in the shape of a bottle, is permanently connected to upper star 12. The handle may be rotated relative to the base 1, causing the rotation of upper star 12, lower star 10 and connecting shaft 8. Thus the stars can be rotated to the removal position (FIG. 1) and into a locking position (FIG. 3).

Figure 2:
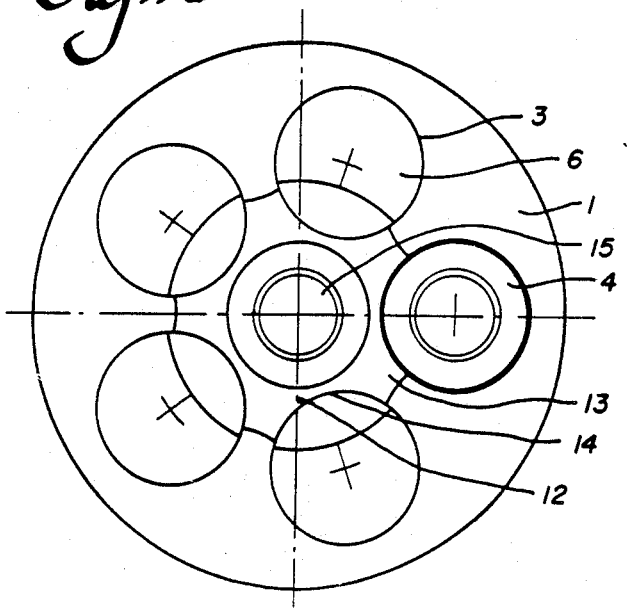
FIG. 2 is a plan view of the embodiment of FIG. 1.

FIG. 2 shows a top view of the embodiment of the bottle dispenser according to FIG. 1, as well as in the removal position. The form of upper star 12 is especially clear here; recesses 14 have a curvature which corresponds to that of receptacles 3. Projections 13 are concavely formed on their edge with a curvature which corresponds to the surface curvature of the bottle at the contact point. Lower star 10 in this instance has essentially the same form as upper star 12.

Figure 3:
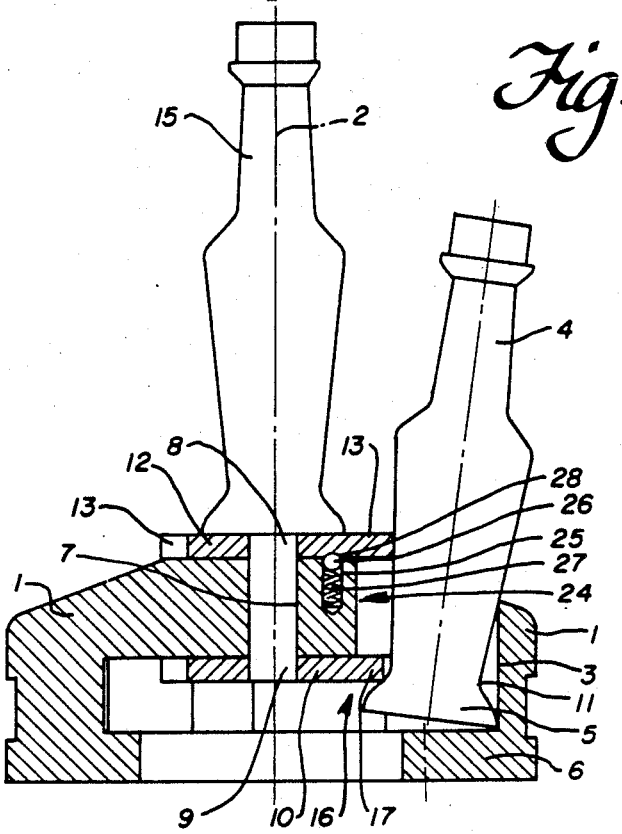
FIG. 3 is a side elevation, partially in section, of an embodiment of FIG. 1 in the locking position.

FIG. 3 shows the arrangement according to FIGS. 1 and 2 in the locking position. In this position, the projections 17 of lower star 10 engage with cross-sectional taperings 11 of bottles 4. This prevents the bottles from falling out of the bottle dispenser. Projections 13 of upper star 12 press the upper part of the bottle outward so that the latter is located in the locking position in a slightly inclined position. In order to remove the bottles from the bottle dispenser, locking device 16 is merely rotated by handle 15 until the recesses in the upper and in the lower star coincide with receptacles 3. When the stars are rotated, the bottles rock back into their vertical position as shown in FIG. 1.

Figure 4:
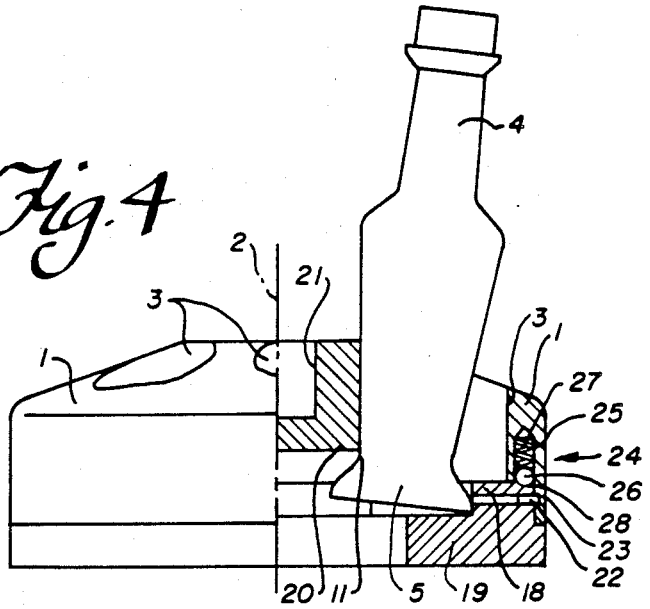
FIG. 4 is a side elevation, partially in section, of another embodiment of the invention in the locking position.

FIG. 4 shows another embodiment of the bottle dispenser. Inwardly directed projections 18 on a ring 19 function as a locking device. These projections bring the bottle into an outwardly inclined position in the locking position. Simultaneously, they press the bottle, by means of its cross-sectional tapering 11, located above foot 5, against edge 20, which receptacle 3 forms on its lower, inner end with base 1. Ring 19 forms a support for base 1 in this embodiment and both parts can be rotated relative to one another. Recesses are located between each two projections 18 of ring 19 which coincide in their curvature with receptacles 3. In the removal position, in which the recesses and receptacles 3 are brought into alignment, bottles 4 can be removed from the bottle dispenser. Base 1 has a centrally located recess 21 which can receive toothpicks, for example. The separation of base 1 from ring 19 forming the support is prevented by two pins 22 in the ring which engage into annular groove 23 located in the base.

A stop device 24 consists of blind bore 25 in base 1 parallel to vertical axis 2 which receives ball 26 and pressure spring 27. Ball 26 is pressed by pressure spring 27 into appropriate recesses 28 in ring 19 (FIG. 4) or in upper star 12 (FIGS. 1,3). The arrangement of recesses 28 is selected in such a manner that locking device 16 stops in its removal positions and in its locking positions.

FIGS. 1, 2 and 4 also illustrate a form of bottle which is suitable for optimum cooperation with preferred embodiments of the bottle dispenser of the invention. Cross-sectional tapering 11 is located immediately above foot 5 of bottle 4. The smallest diameter of the cross-sectional tapering is approximately 65% of the diameter of the foot and is located over approximately 10% of the total height of the bottle. The maximum diameter of the bottle body, which widens out conically in an upward direction, corresponds approximately to the diameter of foot 5 and is located over approximately 55% of the total bottle height.

Preferred bottles for cooperating with preferred embodiments of the bottle dispenser of the invention exhibit the following dimensions: Height: approximately 98 mm; diameter of the foot and greatest diameter of the body: approximately 29 mm; smallest diameter of cross-sectional tapering 11 of the body: approximately 19 mm;

height of the smallest diameter of oross-sectional tapering over the base of the bottle: approximately 10 mm; height of the largest diameter of the body over the standing surface: approximately 52 mm.

It will be understood that the foregoing description has illustrated the invention by reference to preferred embodiments. However, changes may be made in details of construction and mode of operation without departing from the invention, as defined in the claims.

What is claimed is:

1. A bottle dispenser for removably supporting bottles while standing on a table comprising a base which has at least two upwardly open receptacles (3) for bottles (4) into which receptacles the bottles can be placed from above and from which they can be removed in an upward direction, said dispenser having a locking device (16) comprising projecting members (17,20) which are constructed and arranged to engage simultaneously with recesses or cross-sectional taperings (11) of all bottles in said receptacles, said locking device being movable between a locking position in which it engages the bottles to prevent them from falling out of the dispenser and a removal position in which it is disengaged from the bottles so that the bottles can be placed into and removed from the bottle dispenser.

2. A bottle dispenser as set forth in claim 1 in which the receptacles (3) are evenly spaced around a central, vertical axis (2).

3. A bottle dispenser as set forth in claim 2 in which the locking device (16) brings the bottles (4) in the locking position into a position with the bottle neck outwardly inclined.

4. A bottle dispenser as set forth in claim 2 or 3 in which the locking device (16) comprises a star (12) which is located in the upper area of the base (1) and which is mounted for rotation about the vertical axis (2) and which has projections (13) and recesses (14) in its outer perimiter, the number of projections and recesses corresponding to the number of receptacles (3) for the bottles, the projections (13) of the star (12) being constructed and arranged to engage into a cross-sectional tapering or into recesses located in the upper section of the bottle contour or rest on the transition from the body to the neck of the bottles.

5. A bottle dispenser as set forth in claim 3 in which the locking device (16) comprises an upper star (12) and a lower star (10) which are permanently connected to one another by a connecting shaft (8) which is rotatably mounted in a central bore (7) of the base (1) which have projections (13) and recesses (14) in their outer perimiteres and in which the upper star (12) brings the bottles (4) in the locking position into an outwardly inclined position by means of its projections (13) and the lower star (10) engages with its projections (17) into cross-sectional taperings (11) or recesses of the bottles (4) immediately above the bottle feet (5).

6. A bottle dispenser as set forth in claim 5 in which the projections (13,17) of the stars are convex.

7. A bottle dispenser as set forth in claim 5 in which the projections (13,17) of the stars are concave.

8. A bottle dispenser as set forth in one of claims 5–7 in which a handle (15) extending over the bottles in the bottle dispenser is connected to the upper star (12).

9. A bottle dispenser as set forth in claim 8 in which the handle is in the shape of a bottle and is connected in a non-rotating manner to the top of the upper star (12).

10. A bottle dispenser as set forth in claim 3 in which the locking device (16) comprises a ring which can rotate about a vertical axis (2) and has inwardly directed projections (18), the number of inwardly directed projections being the same as the bottle dispenser has receptacles, (3) the ring being constructed and arranged to press the bottles (4) inwardly in the locking position by means of projections (18) on their feet (5), the base having edges (20) which engage in a corresponding cross-sectional tapering or recess (11) above the bottle feet (5).

11. A bottle dispenser as set forth in claim 10 in which the ring (19) forms a support for the base (1) and in which both parts can rotate relative to one another, rotation of these parts relative to each other moving the locking device between the removal position and the locking position for the bottles.

12. A bottle dispenser as set forth in claim 1 including means for stopping the locking device (16) in the removal positions and in the locking positions.

13. A bottle dispenser as set forth in claim 1 including at least one bottle having a cross-sectional tapering or a recess (11) immediately above the foot (5) of the bottle (4) which can engage a projecting part (17, 20) of the locking device (16) of the bottle dispenser.

* * * * *